United States Patent [19]

Sakai et al.

[11] Patent Number: 4,865,957

[45] Date of Patent: Sep. 12, 1989

[54] COLOR PHOTOGRAPHIC LIGHT-SENSITIVE MATERIAL COMPRISING A COMBINATION OF CYAN COUPLERS AND UV ABSORBERS

[75] Inventors: Minoru Sakai; Keiichi Adachi, both of Kanagawa, Japan

[73] Assignee: Fuji Photo Film Co., Ltd., Kanagawa, Japan

[21] Appl. No.: 919,398

[22] Filed: Oct. 15, 1986

[30] Foreign Application Priority Data

Oct. 17, 1985 [JP] Japan ..... 60-232089
Jan. 17, 1986 [JP] Japan ..... 61-7580

[51] Int. Cl.[4] ..... G03C 1/46; G03C 7/32; G03C 7/34

[52] U.S. Cl. ..... 430/505; 430/512; 430/551; 430/552; 430/553; 430/931

[58] Field of Search ..... 430/551, 512, 931, 505, 430/552, 553

[56] References Cited

U.S. PATENT DOCUMENTS 3,698,907 10/1972 Sato et al. ..... 430/512
3,772,002 11/1973 Ramello ..... 430/553
4,456,681 6/1984 Kadowaki et al. ..... 430/551
4,622,287 11/1986 Umemoto et al. ..... 430/505

FOREIGN PATENT DOCUMENTS 0221844 12/1983 Japan ..... 430/512

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A silver halide photographic material is disclosed, comprising a reflective support having provided thereon a silver halide emulsion layer containing at least one 2,5-diacylaminophenol cyan coupler, a silver halide emulsion layer containing a magenta coupler, and a silver halide emulsion layer containing a yellow coupler, wherein said silver halide emulsion layer containing a cyan coupler and/or a photographic layer that is farther from the support than the cyan coupler-containing layer contains at least one of 2-(2'-hydroxyphenyl)benzotriazole ultraviolet absorbents and at least one of benzophenone ultraviolet absorbents. By the combined use of the 2-(2'-hydroxyphenyl)benzotriazole ultraviolet absorbents and the benzophenone ultraviolet absorbents, light-fastness of a cyan image is markedly improved, to provide a color image having a satisfactory color balance.

14 Claims, No Drawings

COLOR PHOTOGRAPHIC LIGHT-SENSITIVE MATERIAL COMPRISING A COMBINATION OF CYAN COUPLERS AND UV ABSORBERS

FIELD OF THE INVENTION

This invention relates to a color photographic light-sensitive material particularly suited for prints.

BACKGROUND OF THE INVENTION

Conventional color photographic light-sensitive materials for prints generally comprise a reflective support having provided thereon a blue-sensitive silver halide emulsion layer containing a yellow coupler, a first light-insensitive intermediate layer, a green-sensitive silver halide emulsion layer containing a magenta coupler, a second light-insensitive intermediate layer, a red-sensitive silver halide emulsion layer containing a cyan coupler and a light-insensitive protective layer in this order.

Of known cyan couplers, 2,5-diacylaminophenol couplers are associated with a problem that the cyan image produced therefrom by oxidative coupling is liable to discoloration with time due to poor light-fastness, and this tends to destroy the color balance with a magenta image and a yellow image in combination, resulting in poor color reproduction.

In order to improve light-fastness of 2,5-diacylaminophenol couplers, it has been proposed to add one or more of 2-(2'-hydroxyphenyl)benzotriazole ultraviolet absorbents to a protective layer or a second intermediate layer as disclosed in Japanese Patent Application (OPI) Nos. 221844/83, 46646/84 and 109055/84 (the term "OPI" as herein used means "unexamined published application").

However, the benzotriazole ultraviolet absorbents should be used in considerably large quantities for achieving desired effects, whereby the amount of a binder to be used should be so increased. The increased amount of a binder necessarily increases film thickness, causing various problems, such as unsatisfactory color reproduction, reduced development rates, insufficient desilvering, insufficient washing, reduced densities due to film turbidity, etc.

SUMMARY OF THE INVENTION

One object of this invention is to provide a color photographic light-sensitive material which produces a dye image having significantly improved light-fastness, so as to have an improved color balance, by using a reduced amount of an ultraviolet absorbent.

As a result of extensive investigations, it has now been found that the above object can be accomplished effectively by a silver halide photographic material comprising a reflective support having provided thereon a silver halide emulsion layer containing at least one cyan coupler represented by formula (I) described below, a silver halide emulsion layer containing a magenta coupler and a silver halide emulsion layer containing a yellow coupler, wherein at least one of said silver halide emulsion layer containing a cyan coupler and a photographic layer that is farther from the support than the cyan coupler-containing silver halide emulsion layer contains at least one of 2-(2'-hydroxyphenyl)benzotriazole compounds represented by formula (II) described below and at least one of benzophenone compounds represented by formula (III) described below.

Formula (I) is represented by

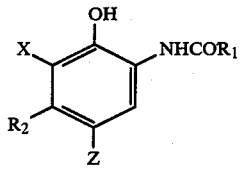

(I)

wherein $R_1$ represents a substituted or unsubstituted aliphatic, aromatic, or heterocyclic group or a substituted or unsubstituted aromatic amino or heterocyclic amino group; $R_2$ represents a substituted or unsubstituted acylamino group; X represents a hydrogen atom, a halogen atom, a substituted or unsubstituted aliphatic or aromatic group or a substituted or unsubstituted acylamino group; Z represents a hydrogen atom or a group releasable upon oxidative coupling with a developing agent; or $R_2$ and X together form a 5- to 7-membered ring; and the coupler may be a polymer, inclusive of a dimer, formed at one of $R_1$, $R_2$, X, and Z.

Formula (II) is represented by

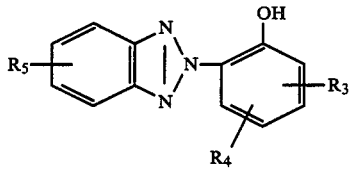

(II)

wherein $R_3$, $R_4$, and $R_5$ each represents a hydrogen atom, a halogen atom, a nitro group, a hydroxyl group or a substituted or unsubstituted alkyl, alkoxy, aryl, aryloxy, or acylamino group.

Formula (III) is represented by

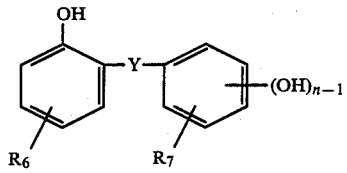

(III)

wherein $R_6$ and $R_7$ each represents a hydrogen atom or a substituted or unsubstituted alkyl, alkoxy, or acyl group; Y represents —CO— or —COO—; and n represents an integer of from 1 to 4.

DETAILED DESCRIPTION OF THE INVENTION

In the above described formula (I), $R_1$ preferably represents an aliphatic group having from 1 to 36 carbon atoms, an aromatic group having from 6 to 36 carbon atoms (e.g., a phenyl group, a naphthyl group, etc.), a heterocyclic group (e.g., a 3-pyridyl group, a 2-furyl group, etc.) or an aromatic or heterocyclic amino group (e.g., an anilino group, a naphthylamino group, a 2-benzothiazolyl group, a 2-pyridylamino group, etc.). Substituents for these groups include an alkyl group, an aryl group, a heterocyclic group, an alkoxy group (e.g., a methoxy group, a 2-methoxyethoxy group, etc.), an aryloxy group (e.g., a 2,4-di-t-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluenesulfonyloxy group, etc.), an amido group (e.g., an acetylamino group, an ethylcarbamoyl group, a dimethylcarbamoyl group, a methanesulfonamido group, a butylsulfamoyl group, etc.), a sulfamido group (e.g., a dipropylsulfamoylamino group, etc.), an imido group (e.g., a succinimido group, a hydantoinyl group, etc.), an ureido group (e.g., a phenylureido group, a dimethylureido group, etc.), an aliphatic or aromatic sulfonyl group (e.g., a methanesulfonyl group, a phenylsulfonyl group, etc.), an aliphatic or aromatic thio group (e.g., an ethylthio group, a phenylthio group, etc.), a hydroxyl group, a cyano group, a carboxyl group, a nitro group, a sulfo group, a halogen atom, etc.

The term "aliphatic group" as used herein means any of straight chain, branched and cyclic saturated or unsaturated groups typically including a methyl group, an ethyl group, a butyl group, a dodecyl group, an octadecyl group, a eicosenyl group, an iso-propyl group, a t-butyl group, a t-octyl group, a t-dodecyl group, a cyclohexyl group, a cyclopentyl group, an allyl group, a vinyl group, a 2-hexadecenyl group, a propargyl group, etc.

The term "heterocyclic" group as used herein preferably includes a 5-membered, 6-membered or 7-membered ring containing at least one atom of O, N and S as a hetero atom.

$R_2$ preferably represents an acylamino group having from 1 to 36 carbon atoms (e.g., an acetylamino group, a butyrylamino group, a tetradecanoylamino group, a benzoylamino group, etc.). These groups may be substituted with substituents such as those enumerated for $R_1$.

X represents a hydrogen atom, a halogen atom (e.g., a fluorine atom, a chlorine atom, a bromine atom, etc.), and preferably an aliphatic group having from 1 to 20 carbon atoms, an aromatic group having from 6 to 20 carbon atoms or an acylamino group having from 2 to 20 carbon atoms. These groups may be substituted with the substituents as enumerated for $R_1$.

$R_2$ and X may be taken together to form a 5- to 7-membered ring. Such a ring preferably includes a 5- to 6-membered nitrogen-containing hetero ring derived from an acylamino group.

Z represents a hydrogen atom or a coupling-releasable group. Examples of the releasable group include a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutyrylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic or aromatic thio group (e.g., an ethylthio group, a phenylthio group, a tetrazolylthio group, etc.), an imido group (e.g., a succinimido group, a hydantoinyl group, etc.), an aromatic azo group (e.g., a phenylazo group, etc.), and the like. These releasable groups may contain a photographically useful group.

Preferred cyan couplers of those represented by formula (I) include those represented by formula (IV)

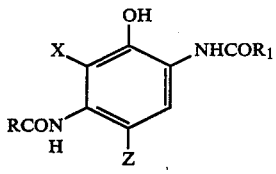

(IV)

wherein $R_1$, X, and Z are the same as defined above; and R represents a substituted alkyl group or a substituted or unsubstituted aryl group.

In formula (IV), $R_1$ preferably represents a substituted alkyl group or a substituted or unsubstituted aryl group. Preferred substituents for the alkyl group include a substituted or unsubstituted phenoxy group and a halogen atom. The aryl group preferably include a phenyl group substituted with at least one halogen atom, alkyl group, sulfonamido group, or acylamino group. Preferred groups for R include a substituted alkyl group and a substituted aryl group and preferred substituents for the substituted alkyl group as represented by R is a substituted or unsubstituted phenoxy group.

X preferably represents a hydrogen atom, an alkyl group, an alkenyl group, an aralkyl group, or an acylamino group.

It is preferable that X and R together form a 5- to 7-membered ring, and more preferably a 5- or 6-membered ring.

Z preferably represents a hydrogen atom or a halogen atom, and more preferably a chlorine atom.

The cyan couplers represented by the formula (I) may be used either individually or in combination thereof. They may also be used in combination with other known couplers that are not limited to cyan couplers. Cyan couplers which may be used in combination with the couplers of the formula (I) include those represented by formula (V)

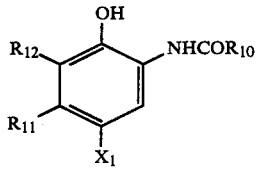

(V)

wherein $X_1$ represents preferably a hydrogen atom or a halogen atom, more preferably a chlorine atom; $R_{10}$ and $R_{12}$ have the same meaning as $R_1$ and $R_2$ in formula (I); $R_{12}$ may also represent a chlorine atom; and $R_{11}$ represents a substituted or unsubstituted aliphatic group having 2 or more carbon atoms, and preferably from 2 to 20 carbon atoms, or a methyl group having a substituent.

In the formula (V), substituents for the aliphatic group as represented by $R_{11}$ include those enumerated from $R_1$. Substituents for the substituted methyl group as represented by $R_{11}$ preferably include a substituted or unsubstituted alkoxy group (e.g., a methoxy group, a butoxy group, a benzyloxy group, etc.), an aryloxy group (e.g., a phenoxy group, a 4-chlorophenoxy group, a 4-cyanophenoxy group, a 4-t-amylphenoxy group, etc.), an alkylthio group (e.g., a methylthio group, a dodecylthio group, etc.), an arylthio group (e.g., a phenylthio group, a 4-chlorophenylthio group, a 4-dodecylphenylthio group, etc.), an alkyl or arylsulfonyl group (e.g., a methanesulfonyl group, a phenylsulfonyl group, a 4-chlorophenylsulfonyl group, etc.), an acylamino group (e.g., an acetylamino group, a benzoylamino group, etc.), an imido group (e.g., a succinimido group, a phthalimido group, a hydantoinyl group, etc.), a ureido group (e.g., a phenylureido group, a methylureido group, etc.) and a cyano group.

$R_{12}$ preferably represents a hydrogen atom or a halogen atom.

The cyan couplers represented by the formula (V) can be used effectively in a proportion of from 5 to 95% by weight based on the amount of cyan coupler of formula (I).

Specific examples of the cyan couplers represented by formula (I) are set forth below.

(C-1)

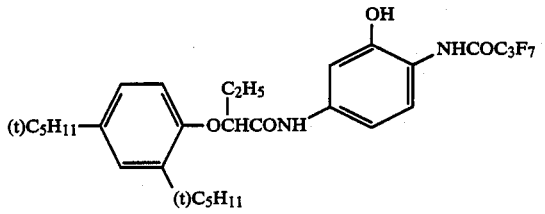

(C-2)

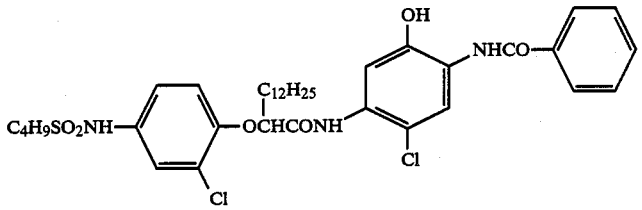

(C-3)

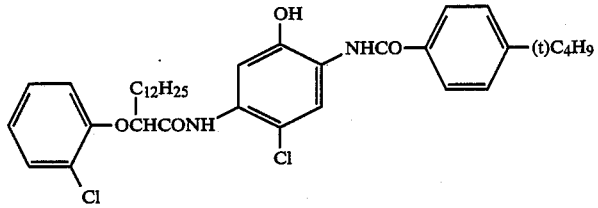

(C-4)

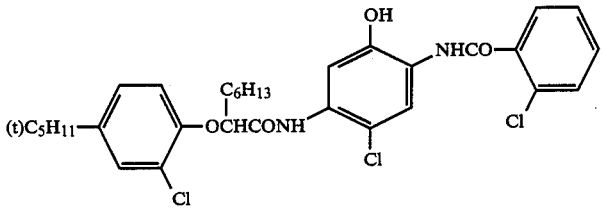

(C-5)

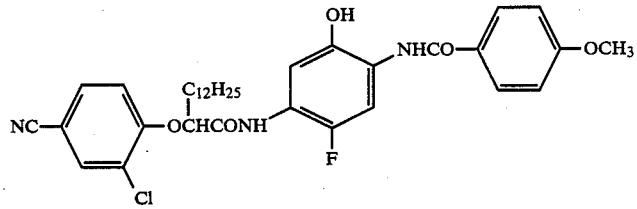

(C-6)

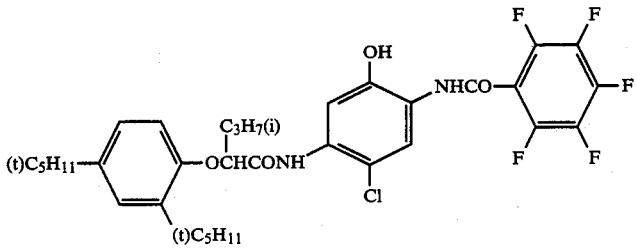

-continued
(C-7)
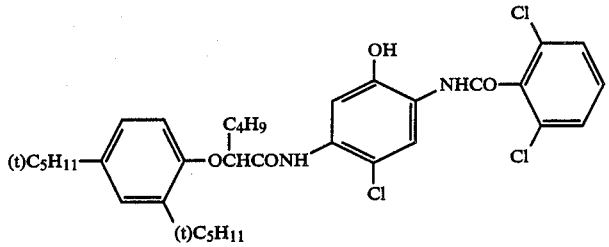
(C-8)
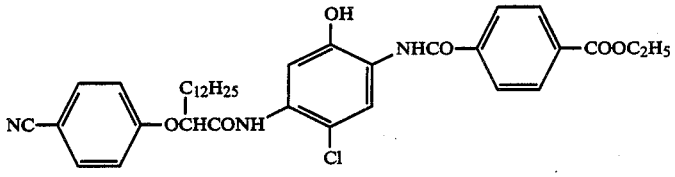
(C-9)
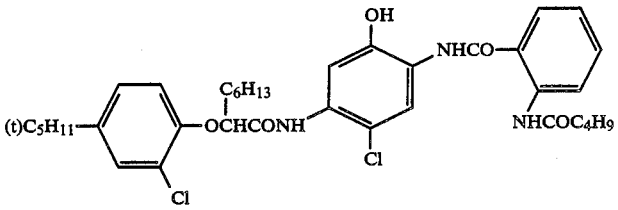
(C-10)
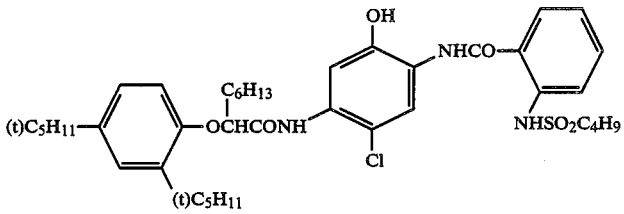
(C-11)
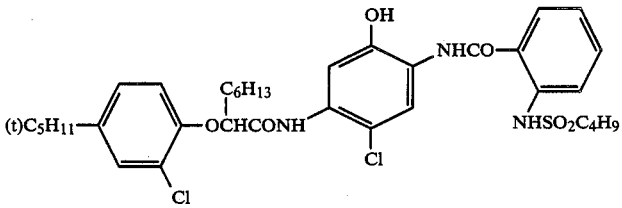
(C-12)
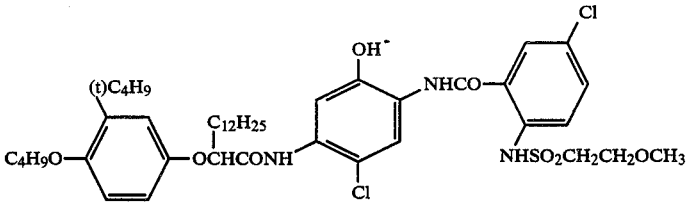
(C-13)
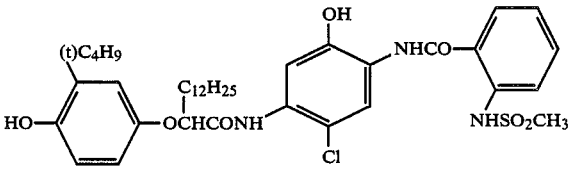

-continued
(C-14)
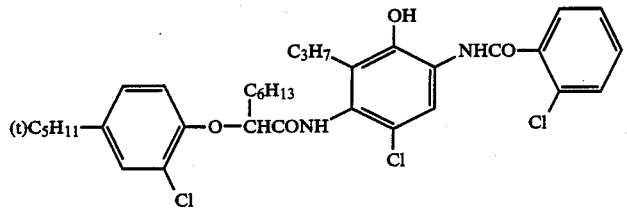
(C-16)
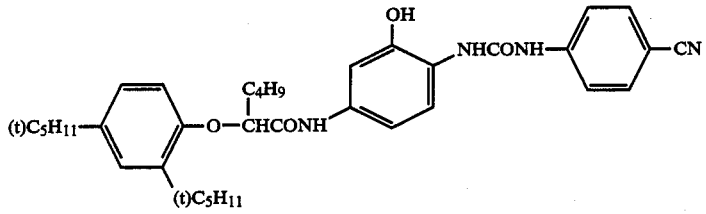
(C-17)
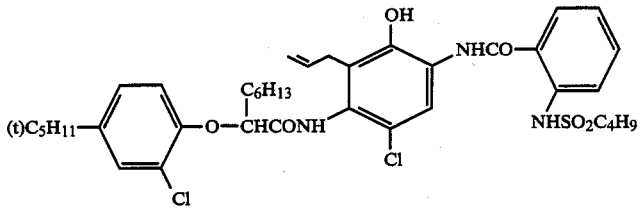
(C-18)
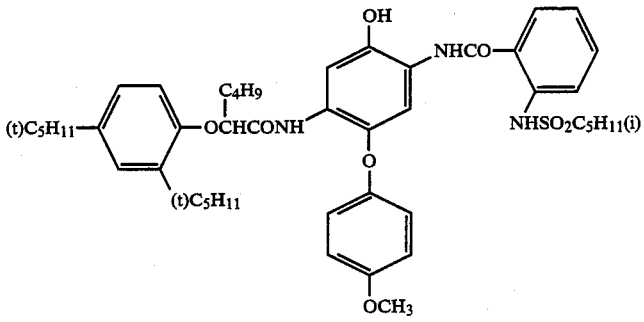
(C-19)
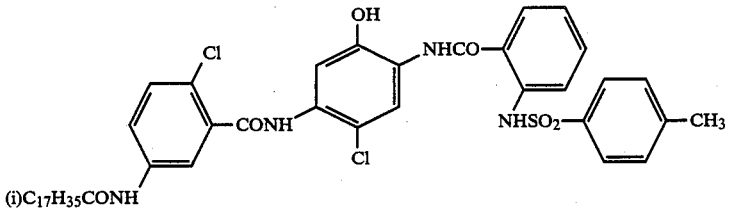
(C-20)
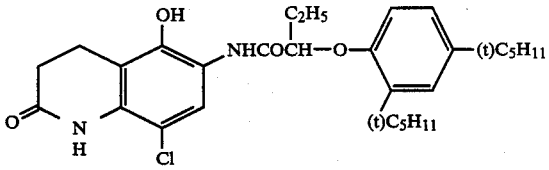
(C-21)
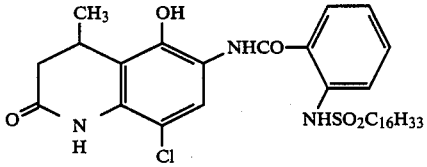

-continued
(C-22)
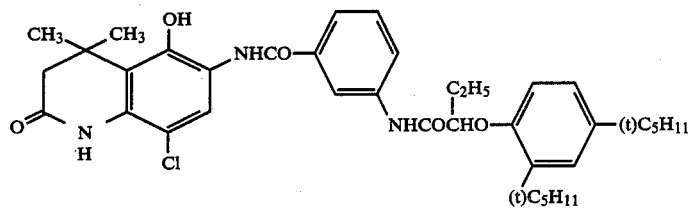
(C-23)
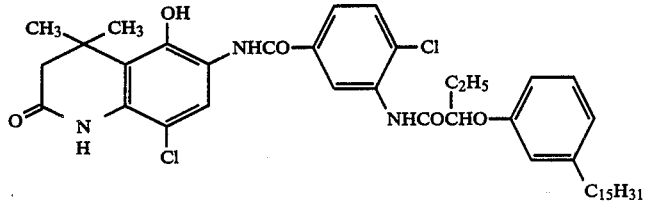
(C-24)
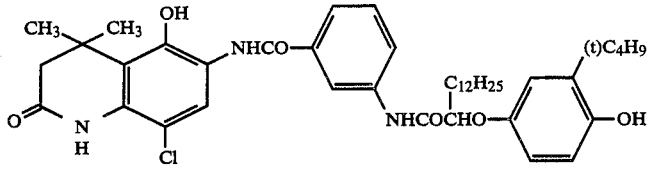
(C-25)
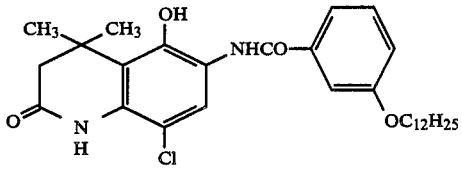
(C-26)
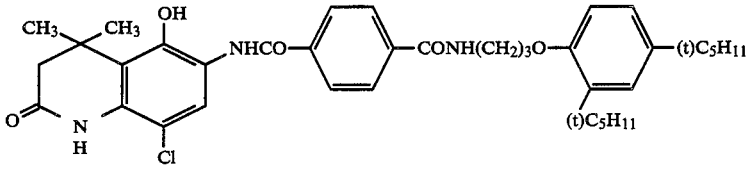
(C-27)
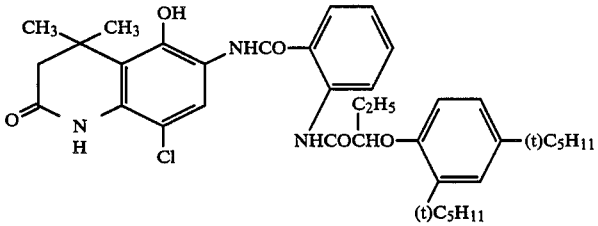
(C-28)
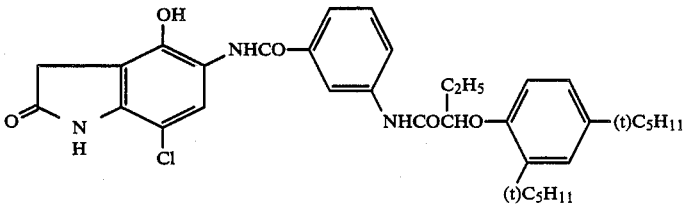

-continued
(C-29)
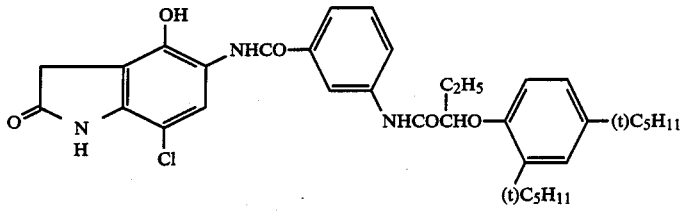
(C-30)
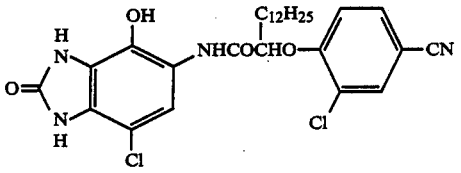
(C-31)
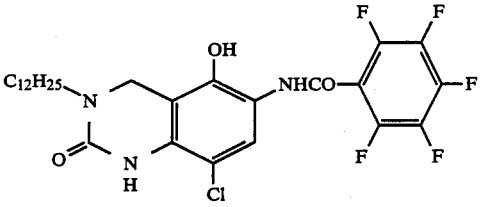
(C-32)
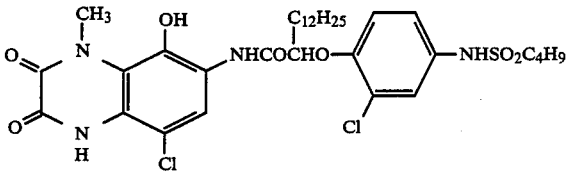
(C-33)
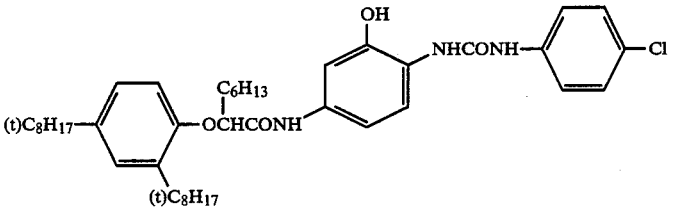
(C-34)
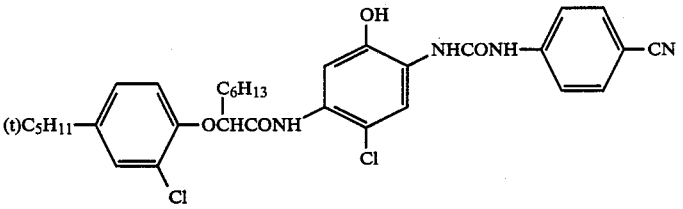
(C-35)
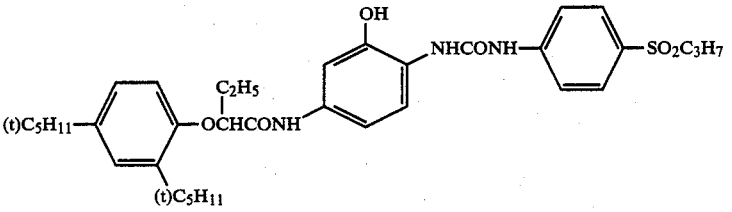

-continued
(C-36)
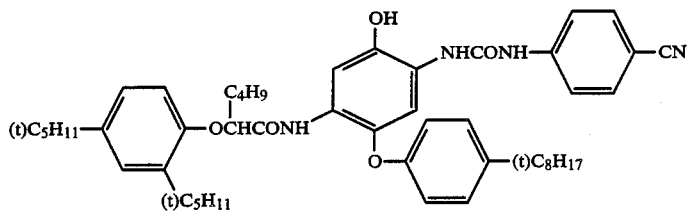
(C-37)
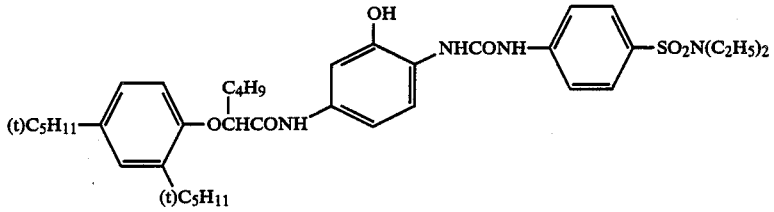
(C-38)
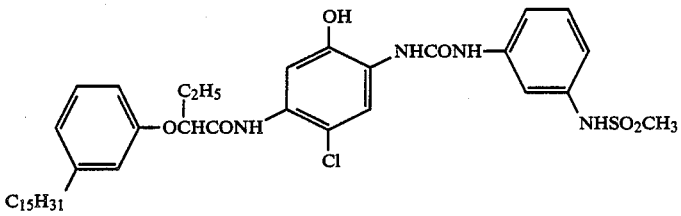
(C-39)
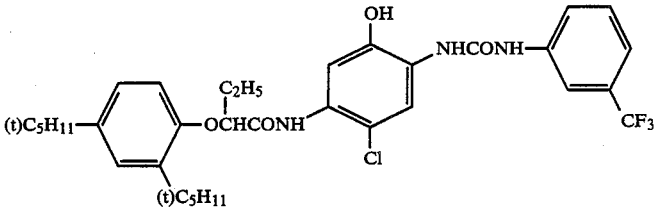
Specific examples of cyan couplers used together with the cyan coupler represented by formula (I) are set forth below.
(C-40)
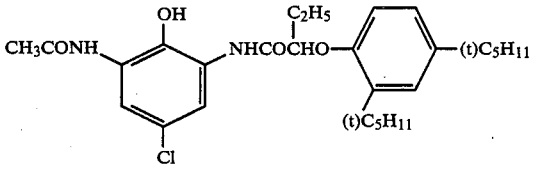
(C-41)
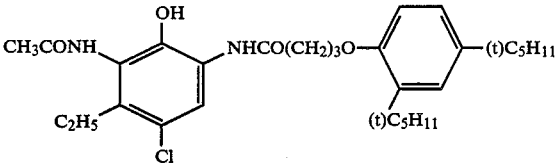
(C-42)
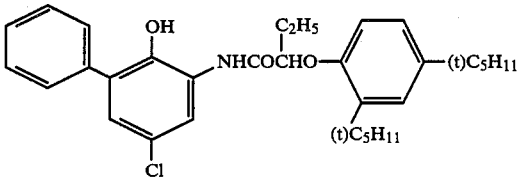

-continued
(C-43)
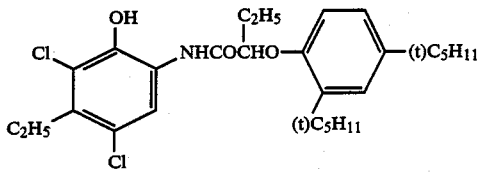
(C-44)
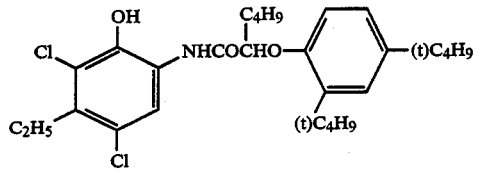
(C-45)
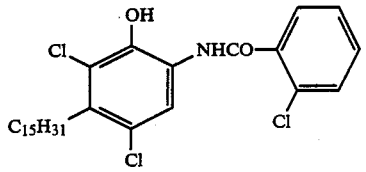
(C-46)
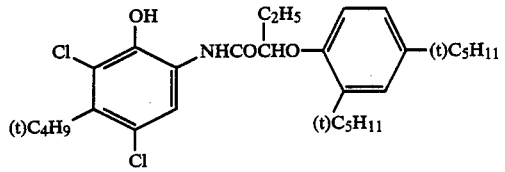
(C-47)
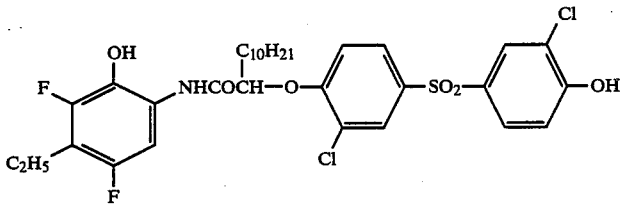
(C-48)
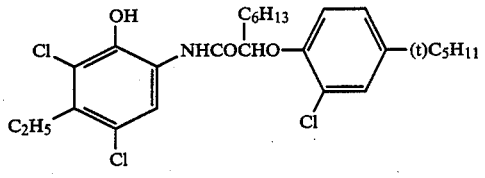
(C-49)
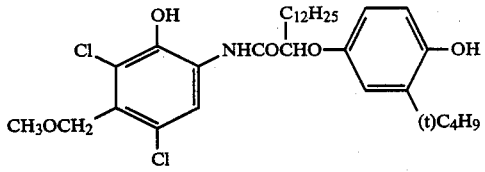
(C-50)
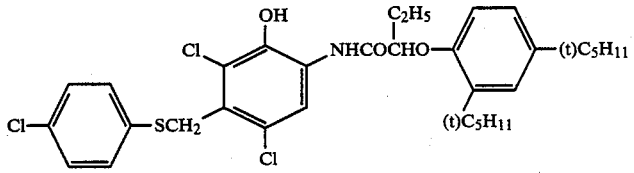

-continued (C-51)

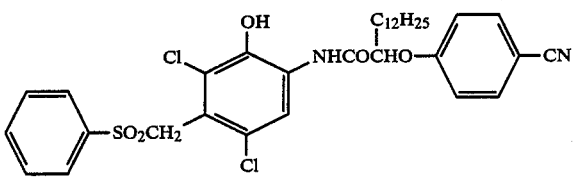

(C-52)

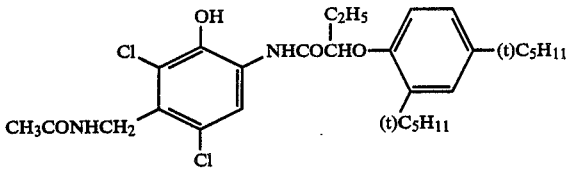

(C-53)

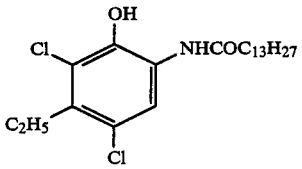

(C-54)

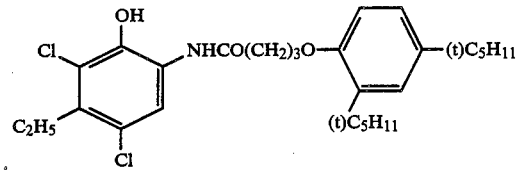

The 2-(2'-hydroxyphenyl)benzotriazole ultraviolet absorbents represented by the formula (II) may be either solid or liquid at room temperature, but is preferably liquid. Specific examples of liquid compounds of formula (II) are described, e.g., in Japanese Patent Publication Nos. 36984/80 and 12587/80, Japanese Patent Application (OPI) No. 214152/83, etc. For details of the ultraviolet absorbents represented by formula (II), reference can be made to it in Japanese Patent Application (OPI) Nos. 221844/83, 46646/84 and 109055/84, Japanese Patent Publication Nos. 10466/61, 26187/67, 5496/73 and 41572/73, U.S. Pat. Nos. 3,754,919 and 4,220,711, etc. Details for the benzophenone ultraviolet absorbents represented by the formula (III) are described in U.S. Pat. No. 3,698,907, Japanese Patent Publication No. 31255/73, etc.

At least one of the ultraviolet absorbents represented by the formula (II) and (III) may also be incorporated into the second intermediate layer from the support surface.

The silver halide photographic materials according to the present invention comprise a reflective support having provided thereon emulsion layers comprising a blue-sensitive layer, a green-sensitive layer, and a red-sensitive layer with an intermediate layer being interposed between each pair of these emulsion layers, and a protective layer as a top layer. The protective layer may be divided into two or more layers. The order of the emulsion layers is not restricted and can be selected arbitrarily, depending upon the intended purposes of the material. Preferably, the reflective support is coated with emulsion layers on the support in the order of a blue-sensitive layer, a green-sensitive layer, and a red-sensitive layer, or in the order of a blue-sensitive layer, a red-sensitive layer, and a green-sensitive layer.

Incorporation of the ultraviolet absorbents into a cyan coupler-containing silver halide emulsion layer and/or other photographic layers (e.g., a protective layer, an intermediate layer between the cyan coupler-containing layer and the top layer, etc.) can be carried out in a conventionally known manner. In more detail, the compound to be incorporated is usually dissolved in a high-boiling point organic solvent having a boiling point of about 175° C. or higher (either alone, or, if desired, in combination with a low-boiling point solvent), and the solution is finely dispersed in a hydrophilic binder (e.g., a gelatin aqueous solution) with an aid of a surface active agent. The resulting dispersion is then added to a desired hydrophilic colloidal layer. The high-boiling organic solvents which can be used here include organic acid amides, carbamates, esters, ketones, urea derivatives, and the like. Specific examples of these solvents are phthalic esters, e.g., dimethyl phthalate, diethyl phthalate, dipropyl phthalate, dibutyl phthalate, di-n-octyl phthalate, diisooctyl phthalate, diamyl phthalate, dinonyl phthalate, diisodecyl phthalate, etc.; phosphoric esters, e.g., tricresyl phosphate, triphenyl phosphate, tri-(2-ethylhexyl) phosphate, triisononyl phosphate, etc.; sebacic esters, e.g., dioctyl sebacate, di-(2-ethylhexyl) sebacate, diisodecyl sebacate, etc.; glycerin esters, e.g., glycerol tripropionate, glycerol tributyrate, etc,; and, in addition, adipic esters, glutaric esters, succinic ester, fumaric esters, maleic esters, citric esters, and so on.

Examples of the low-boiling point solvents which may be used in combination with the high-boiling organic solvents include methyl acetate, ethyl acetate, propyl acetate, butyl acetate, butyl propionate, cyclohexanol, cyclohexane, tetrahydrofuran, methyl alcohol, ethyl alcohol, acetonitrile, dimethylformamide, dioxane, methyl ethyl ketone, methyl isobutyl ketone, diethyl ketone, diethylene glycol monoacetate, acetylacetone, nitromethane, nitroethane, carbon tetrachloride, chloroform, etc.

The above-described ultraviolet absorbents represented by formula (II) and (III) are preferably added in an amount of from 0.01 to 2 parts by weight per part by weight of a binder of the layer in which the ultraviolet absorbents are to be incorporated.

A binder coverage in each photographic layer usually ranges from about 0.1 to about 3 g/m$^2$.

In cases where the ultraviolet absorbent is incorporated in a light-insensitive layer, it is preferable to form an additional light-insensitive layer substantially solely comprising a binder adjacent to such a light-insensitive layer on the side opposite to the support. Formation of such a binder layer is effective to prevent an exudation phenomenon, i.e., loss of surface gloss with time. Such a binder layer generally has a binder coverage of from about 0.1 to about 3 g/m$^2$.

In the cases where the ultraviolet absorbent is added to a silver halide emulsion layer, the optimum amount to be added can be appropriately determined in accordance with the above-recited range.

A preferred proportion of the ultraviolet absorbent of the formula (III) to the ultraviolet absorbent of the formula (II) ranges from 0.1 to 2 by weight.

Specific but non-limiting examples of the ultraviolet absorbents represented by the formula (II) and (III) are listed in Tables 1 and 2, respectively.

TABLE 1

(II)

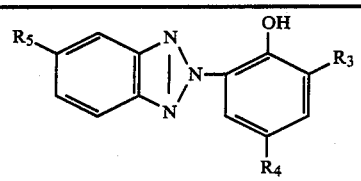

| UV No. | $R_5$ | $R_3$ | $R_4$ |
|---|---|---|---|
| UV-1 | H | H | $-C_4H_9(t)$ |
| UV-2 | H | H | $-C_5H_{11}(t)$ |
| UV-3 | H | H | $-C_{12}H_{25}(n)$ |
| UV-4 | H | H | $-CH_2CH_2COOC_8H_{17}$ |
| UV-5 | Cl | H | $-C_4H_9(t)$ |
| UV-6 | Cl | H | $-C_5H_{11}(t)$ |
| UV-7 | Cl | H | $-CH_2CH_2COOC_8H_{17}$ |
| UV-8 | H | $-CH_3$ | $-C_4H_9(t)$ |
| UV-9 | H | $-C_4H_9(t)$ | $-C_4H_9(t)$ |
| UV-10 | H | $-C_4H_9(sec)$ | $-C_4H_9(t)$ |
| UV-11 | H | $-C_4H_9(t)$ | $-CH_2CH_2COOC_8H_{17}$ |
| UV-12 | H | $-C_5H_{11}(t)$ | $-C_5H_{11}(t)$ |
| UV-13 | Cl | $-C_4H_9(t)$ | $-C_4H_9(t)$ |
| UV-14 | $CH_3O$ | $-C_4H_9(sec)$ | $-C_4H_9(t)$ |
| UV-15 | Cl | $-C_4H_9(sec)$ | $-C_4H_9(sec)$ |
| UV-16 | Cl | $-C_4H_9(t)$ | $-CH_2CH_2COOC_8H_{17}$ |
| UV-17 | Cl | $-C_5H_{11}(t)$ | $-C_5H_{11}(t)$ |
| UV-18 | $-C_4H_9(n)$ | $-C_4H_9(sec)$ | $-C_4H_9(sec)$ |
| UV-19 | $-C_4H_9(sec)$ | $-C_5H_{11}(t)$ | $-C_5H_{11}(t)$ |
| UV-20 | $-C_4H_9(sec)$ | $-C_4H_9(t)$ | $-CH_2CH_2COOC_8H_{17}$ |
| UV-21 | H | $-C_4H_9(t)$ | $-OC_8H_{17}(sec)$ |
| UV-22 | H | $-C_4H_9(t)$ | $-OC_{12}H_{25}(sec)$ |
| UV-23 | Cl | $-C_4H_9(t)$ | $-OC_8H_{17}(sec.)$ |

TABLE 2

(III)

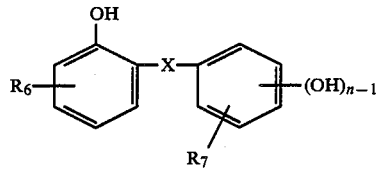

| UV No. | X | $R_6$ | $R_7$ | $(OH)_{n-1}$ |
|---|---|---|---|---|
| UV-24 | —CO— | $5\text{-}OC_4H_9$ | H | H |
| UV-25 | " | $5\text{-}OC_8H_{17}$ | H | H |
| UV-26 | " | $5\text{-}OC_{16}H_{33}$ | H | H |
| UV-27 | " | $5\text{-}OC_{18}H_{37}$ | H | H |
| UV-28 | " | $4\text{-}OC_4H_9$ | $4'\text{-}OCH_3$ | 2',5'-OH |
| UV-29 | " | $5\text{-}COCH_3$ | $3'\text{-}C_8H_{17}$ | 2,6-OH |
| UV-30 | " | $5\text{-}C_{12}H_{25}$ | $4'\text{-}COCH_3$ | 2'-OH |
| UV-31 | " | $5\text{-}COCH_3$ | $3'\text{-}C_8H_{17}$ | 2',6'-OH |
| UV-32 | " | $4\text{-}OC_{12}H_{25}$ | 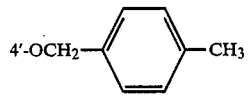 | 2'-OH |
| UV-33 | " | $5\text{-}C_8H_{17}$ | 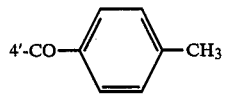 | 2',6'-OH |
| UV-34 | —COO— | $4\text{-}C_{12}H_{25}$ | $4'\text{-}C_4H_9(t)$ | H |
| UV-35 | " | H | $4'\text{-}C_{12}H_{25}$ | H |
| UV-36 | " | $4\text{-}OC_{12}H_{25}$ | $5'\text{-}OCH_3$ | 2'-OH |
| UV-37 | " | $3\text{-}OCH_3$ | $5'\text{-}OC_{12}H_{25}$ | 2'-OH |
| UV-38 | " | $5\text{-}C_8H_{17}$ | $4'\text{-}COCH_3$ | H |
| UV-39 | " | $4\text{-}OC_{12}H_{25}$ | $4'\text{-}OC_{12}H_{25}$ | H |
| UV-40 | " | $5\text{-}C_8H_{17}(t)$ | 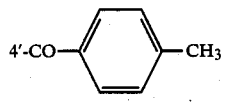 | H |

TABLE 2-continued

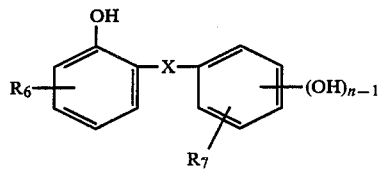

(III)

| UV No. | X | $R_6$ | $R_7$ | $(OH)_{n-1}$ |
|---|---|---|---|---|
| UV-41 | " | 5-$OC_8H_{17}$ | 5'-$COCH_3$ | 2'-OH |
| UV-42 | " | 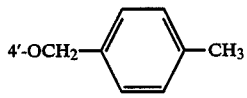 | 4'-$OC_{12}H_{25}$ | H |
| UV-43 | " | 4-$COCH_3$ | 4'-$C_{16}H_{37}$ | 2'-OH |

Silver halide emulsions to be used in the present invention are not particularly limited. Among others, silver chlorobromide emulsions and silver iodochlorobromide emulsions containing not more than 2 mol % of silver iodide are preferred.

The light-sensitive materials of the present invention preferably contain oil-soluble two- or four-equivalent magenta couplers or yellow couplers as color image forming couplers.

Yellow couplers which can be used in the invention typically include oil-protected type acylacetamide couplers. Specific examples of such couplers are described in U.S. Pat. Nos. 2,407,210, 2,875,057 and 3,265,506, etc. In the present invention, use of 2-equivalent yellow couplers is desirable. Typical examples of 2-equivalent yellow couplers include those releasable at an oxygen atom as described, e.g., in U.S. Pat. Nos. 3,408,194, 3,447,928, 3,933,501 and 4,022,620, etc.; and those releasable at a nitrogen atom as described, e.g., in Japanese Patent Publication No. 10739/83, U.S. Pat. Nos. 4,401,752 and 4,326,024, *Research Disclosure*, RD No. 18053 (April 1979), British Patent No. 1,425,020, West German Patent Publication Nos. 2,219,917, 2,261,361, 2,329,587 and 2,433,812, etc. For accomplishing the object of this invention, α-pivaloylacetanilide couplers are preferably employed.

Magenta couplers which can be used in the present invention include 5-pyrazolone couplers and pyrazoloazole couplers, with the latter being preferred for accomplishing the object of the invention. Specific examples of such couplers are described, e.g., in U.S. Pat. No. 4,540,654, Japanese Patent Application (OPI) No. 125732/84, etc.

The reflective support which can be used in the present invention preferably includes baryta paper and a paper support laminated with polyethylene containing a white pigment, e.g., titanium oxide.

The light-sensitive materials in accordance with the present invention can be used in various applications, such as color paper, color reversal paper, and the like.

The invention is now illustrated in greater detail with reference to the following examples, but it should be understood that they are not intended to limit the present invention.

EXAMPLE 1

A color light-sensitive material was prepared by coating the following first to 7th layers on a paper support having laminated on both sides of polyethylene. The polyethylene laminate layer on the side to be coated contained titanium dioxide in an amount sufficient to provide a color background of the images and a trace amount of ultramarine.

| | |
|---|---|
| 1st Layer: Blue-Sensitive Layer | |
| Silver chlorobromide emulsion (silver bromide content: 80 mol %) | 0.39 g-Ag/$m^2$ |
| Yellow coupler (*1) | 0.70 g/$m^2$ |
| Solvent for coupler (TNP) | 0.15 g/$m^2$ |
| Gelatin | 1.20 g/$m^2$ |
| 2nd Layer: Intermediate Layer | |
| Gelatin | 0.90 g/$m^2$ |
| Di-t-octylhydroquinone | 0.05 g/$m^2$ |
| Solvent (DBP) | 0.10 g/$m^2$ |
| 3rd Layer: Green-Sensitive Layer | |
| Silver chlorobromide emulsion (silver bromide content: 70 mol %) | 0.15 g-Ag/$m^2$ |
| Magenta coupler (*2) | 0.32 g/$m^2$ |
| Solvent for coupler (THP) | 0.44 g/$m^2$ |
| Discoloration inhibitor (*3) | 0.19 g/$m^2$ |
| Gelatin | 1.35 g/$m^2$ |
| 4th Layer: Ultraviolet-Absorbing Intermediate Layer | |
| Ultraviolet absorbents (UV-15/UV-16/UV-9 = 6/25/25 by weight) | 0.56 g/$m^2$ |
| Solvent (TNP) | 0.20 g/$m^2$ |
| Gelatin | 0.90 g/$m^2$ |
| 5th Layer: Red-Sensitive Layer | |
| Silver chlorobromide emulsion (silver bromide content: 50 mol %) | 0.20 g-Ag/$m^2$ |
| Cyan coupler (*4/*5 = 6/5 by weight) | 0.44 g/$m^2$ |
| Solvent for coupler (TNP/DBP = ½ by weight) | 0.30 g/$m^2$ |
| Gelatin | 0.9 g/$m^2$ |
| 6th Layer: Ultraviolet-Absorbing Intermediate Layer | |
| Ultraviolet absorbents (UV-1/UV-10/UV-13 = 1/1/1 by weight) | 0.20 g/$m^2$ |
| Solvent (DBP) | 0.20 g/$m^2$ |
| Gelatin | 0.15 g/$m^2$ |
| 7th Layer: Protective Layer | |
| Gelatin | 1.5 g/$m^2$ |

Note:
DBP, THP, and TNP stand for dibutyl phthalate, tri-n-hexyl phosphate and tri-n-nonyl phosphate, respectively.

Compounds used in the above sample are shown below:

(*1)

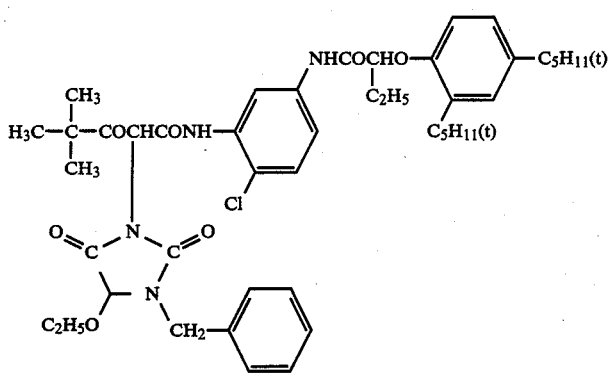

(*2)

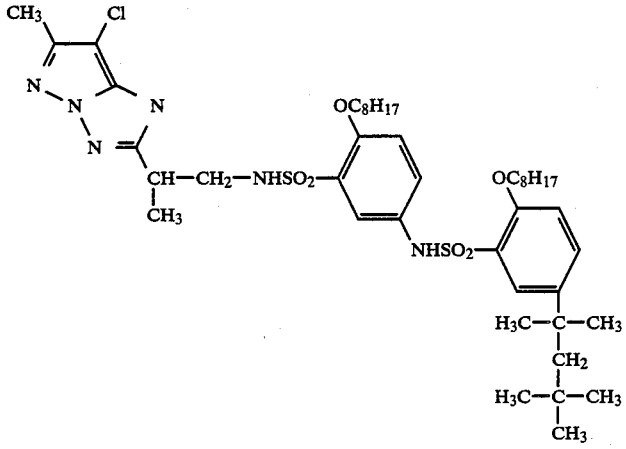

(*3)

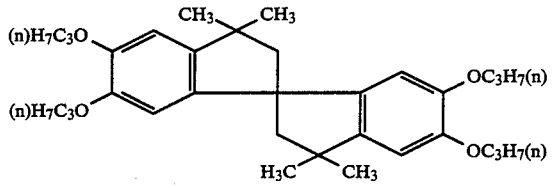

(*4)

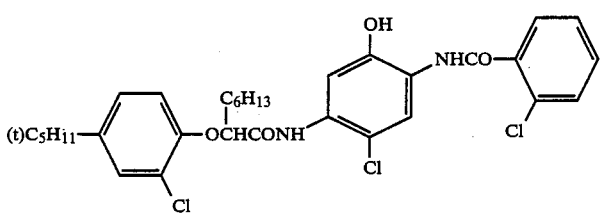

(*5)

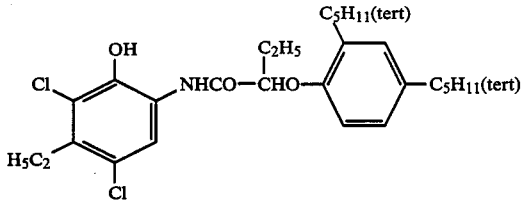

In the above-described emulsion layers, the following dyes were used as spectral sensitizers.

Blue-Sensitive Emulsion Layer:

Triethyl ammonium 4-{5-chloro-2-[5-chloro-3-(4-sulfonatobutyl)benzothiazolin-2-ylidenemethyl]-3-benzothiazolio}butanesulfonate ($2\times10^{-4}$ mol/mol-Ag)

Green-Sensitive Emulsion Layer:

Sodium 3,3'-di-(γ-sulfopropyl)-5,5'-diphenyl-9-ethyloxacarbocyanine ($2.5\times10^{-4}$ mol/mol-Ag)

Red-Sensitive Emulsion Layer:

Sodium 3,3'-di-(γ-sulfopropyl)-9-methylthiadicarbocyanine ($2.5\times10^{-4}$ mol/mol-Ag)

In the above-described emulsion layers, the following dyes were employed as anti-irradiation agents.

Green-Sensitive Emulsion Layer:

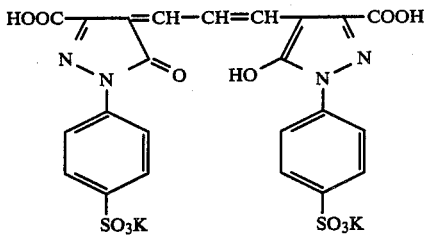

Red-Sensitive Emulsion Layer:

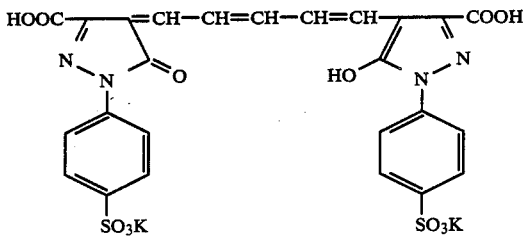

The resulting light-sensitive emulsion was designated as Sample A.

Samples B to F were prepared in the same manner as for Sample A except for changing the ultraviolet absorbents used in the 6th layer as indicated in Table 3 below.

TABLE 3

| Sample No. | Ultraviolet Absorbent | Weight Ratio | Coverage ($g/m^2$) | Remark |
|---|---|---|---|---|
| B | UV-11/UV-13 | 1/1 | 0.2 | Comparison |
| C | " | " | 0.3 | " |
| D | " | " | 0.6 | " |
| E | UV-11/UV-13/UV-26 | 1/1/1 | 0.3 | Invention |
| F | UV-11/UV-13/UV-31 | 1/1/11 | 0.3 | " |

Each of Samples A to F was exposed to light through an optical wedge for sensitometry by the use of an enlarger (Fuji Color Head 609, manufactured by Fuji Photo Film Co., Ltd.) and then development-processed in according to the following processing steps using the following processing solutions.

| Processing Step | Temperature (°C.) | Time (min.) |
|---|---|---|
| Development | 33 | 3.5 |
| Bleach-Fix | 33 | 1.5 |
| Washing | 28–35 | 3.0 |

Developing Solution:

| | |
|---|---|
| Diethylenetriaminepentaacetic acid | 1.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N—ethyl-N—[β-(methanesulfonamido)ethyl]-p-phenylenediamine sulate | 5.0 g |
| $Na_2CO_3$ (monohydrate) | 30 g |
| Fluorescent brightening agent (4,4'-diaminostilbene type) | 1.0 g |
| Water to make | 1 liter |
| | pH = 10.1 |

Bleach-Fixing Solution:

-continued

| Processing Step | Temperature (°C.) | Time (min.) |
|---|---|---|
| Ammonium thiosulfate (70 wt %) | | 150 ml |
| $Na_2SO_3$ | | 15 g |
| $NH_4$[Fe(EDTA)] | | 55 g |
| EDTA.2Na | | 4 g |
| Water to make | | 1 liter |
| | | pH = 6.9 |

Each of the thus processed films was tested for light-fastness of the cyan image under the following testing conditions. After the testing, a color density of the area having an initial color density of 2.0 before the testing was determined as a measure of light-fastness. The results obtained are shown in Table 4.

Testing Conditions:

| Light Source | Exposure Time |
|---|---|
| Xenon fademeter (85,000 lux) | 200 hrs. |
| Fluorescent lamp fademeter (17,000 lux) | 3 months |
| Direct sunlight | 3 months |

TABLE 4

| Sample No. | Xenon | Fluorescent Lamp | Sunlight |
|---|---|---|---|
| A | 1.53 | 1.61 | 1.55 |
| B | 1.54 | 1.62 | 1.56 |
| C | 1.59 | 1.67 | 1.60 |
| D | 1.70 | 1.82 | 1.73 |
| E | 1.75 | 1.81 | 1.73 |
| F | 1.73 | 1.80 | 1.74 |

On comparing Samples B and C, it can be seen that an increase of the amount of the 2-(2'-hydroxyphenyl)benzotriazole ultraviolet absorbents by 50% produces only a slight effect on improving light-fastness. Sample D having a three-fold increased coverage of the ultraviolet absorbent shows a significant effect on improvement of light-fastness.

On the other hand, from the results of Samples E and F according to the present invention, it can be seen that a remarkable light-fastness improving effect equal to Sample D can be produced with a half the coverage as use in Sample D by using a combination of the 2-(2'-hydroxyphenyl)benzotriazole ultraviolet absorbent and the benzophenone ultraviolet absorbent.

It would be apparent from these results that a combined use of 2-(2'-hydroxyphenyl)benzotriazole ultraviolet absorbents and benzotriazole ultraviolet absorbents greatly improves light-fastness with a reduced coverage of the ultraviolet absorbents.

EXAMPLE 2

Samples G to L were prepared in the same manner as for Sample A of Example 1, except for changing the ultraviolet absorbents used in the 6th layer, as indicated in Table 5. Each of these samples was sensitometrically exposed to light, developed and tested in the same manner as in Example 1, except that the exposure time in the testing with a xenon fademeter was changed to 300 hours. After the testing, a color density of the area having an initial color density of 2.0 before the testing was determined as a measure of light-fastness. The results obtained are shown in Table 6.

TABLE 5

| Sample No. | Ultraviolet Absorbent | Weight Ratio | Coverage ($g/m^2$) | Remark |
|---|---|---|---|---|
| G | UV-15/UV-16/UV-9 | 1/4/4 | 0.2 | Comparison |
| H | UV-15/UV-12 | 1/4 | 0.2 | " |
| I | " | " | 0.3 | " |
| J | " | " | 0.6 | " |
| K | UV-15/UV-12/UV-26 | 2/8/5 | 0.3 | Invention |
| L | UV-15/UV-12/UV-31 | 2/8/5 | 0.3 | " |

TABLE 6

| Sample | Xenon | | | Fluorescent Lamp | | | Sunlight | | | |
|---|---|---|---|---|---|---|---|---|---|---|
| No. | Cyan | Magenta | Yellow | Cyan | Magenta | Yellow | Cyan | Magenta | Yellow | Remark |
| G | 1.56 | 1.80 | 1.77 | 1.61 | 1.74 | 1.75 | 1.55 | 1.73 | 1.77 | Comparison |
| H | 1.55 | 1.81 | 1.76 | 1.60 | 1.76 | 1.75 | 1.53 | 1.73 | 1.76 | " |
| I | 1.60 | 1.81 | 1.77 | 1.65 | 1.76 | 1.76 | 1.59 | 1.74 | 1.77 | " |
| J | 1.75 | 1.81 | 1.80 | 1.75 | 1.78 | 1.78 | 1.74 | 1.77 | 1.79 | " |
| K | 1.75 | 1.80 | 1.78 | 1.81 | 1.79 | 1.79 | 1.75 | 1.76 | 1.80 | Invention |
| L | 1.76 | 1.82 | 1.80 | 1.79 | 1.80 | 1.80 | 1.77 | 1.75 | 1.78 | " |

It can be seen from the results of Table 6 that Sample J exhibits markedly improved light-fastness over Sample H and that the improvement arises from the threefold increase in coverage of the 2-(2'-hydroxyphenyl)-benzotriazole ultraviolet absorbent. On the other hand, Samples K and L show light-fastness equal or superior to Sample J. These improvements in Samples K and L can be achieved by a combined use of the 2-(2'-hydroxyphenyl)benzotriazole ultraviolet absorbents and the benzophenone ultraviolet absorbents with a total coverage of ultraviolet absorbents being increased only by 50% over Sample H. Such a great improving effect cannot be produced simply by increasing the coverage of the ultraviolet absorbent of Sample H by 50% as in Sample I.

From all these considerations, it is obvious that a combined use of 2-(2'-hydroxyphenyl)benzotriazole ultraviolet absorbents of the formula (II) and benzophenone ultraviolet absorbents of the formula (III) is very effect to improve light-fastness of a color image, particularly the cyan image, to provide a well-balanced color image.

EXAMPLE 3

Sample M was prepared by coating the following first to 7th layers on the same support as used in Sample 1.

1st and 2nd Layers: The same as the 1st and 2nd layers as in Sample A of Example 1.

| | |
|---|---|
| 3rd Layer: Red-Sensitive Layer | |
| Silver chlorobromide emulsion (silver bromide content: 50 mol %) | 0.20 g-Ag/$m^2$ |
| Cyan coupler (*4/*5 = 6/5 by weight) | 0.44 g/$m^2$ |
| Solvent for coupler (TNP/DBP = ½ by weight) | 0.30 g/$m^2$ |
| Gelatin | 0.9 g/$m^2$ |

-continued

| | |
|---|---|
| 4th Layer: Ultraviolet-Absorbing Intermediate Layer | |
| Ultraviolet absorbents (UV-15/UV-16/UV-9 = 1/4/4 by weight) | 0.18 g/$m^2$ |
| Solvent (TNP) | 0.20 g/$m^2$ |
| Gelatin | 0.90 g/$m^2$ |
| 5th Layer: Green-Sensitive Layer | |
| Silver chlorobromide emulsion (silver bromide content: 70 mol %) | 0.15 g-Ag/$m^2$ |
| Magenta coupler (2) | 0.32 g/$m^2$ |
| Solvent for coupler (THP) | 0.44 g/$m^2$ |
| Discoloration inhibitor (*3) | 0.19 g/$m^2$ |
| Gelatin | 1.35 g/$m^2$ |
| 6th Layer: Ultraviolet-Absorbing Intermediate Layer | |
| Ultraviolet absorbents (UV-15/UV-16/UV-9 = 1/4/4 by weight) | 0.20 g/$m^2$ |
| Solvent (DBP) | 0.20 g/$m^2$ |
| Gelatin | 0.15 g/$m^2$ |
| 7th Layer: Protective Layer | |
| Gelatin | 1.5 g/$m^2$ |

In the above-described formulation, the terms "DBP", "THP" and "TNP" have the same meanings as described in Example 1. The cyan and magenta couplers, the discoloration inhibitors, spectral sensitizers, and anti-irradiation dyes used in Sample M were the same as in Sample A of Example 1.

Samples N to R were prepared in the same manner as for Sample M, except for changing the ultraviolet absorbents used in the 6th layer, as indicated in Table 7 below.

TABLE 7

| Sample No. | Ultraviolet Absorbent | Weight Ratio | Coverage ($g/m^2$) | Remark |
|---|---|---|---|---|
| M | UV-15/UV-16/UV-9 | 1/4/4 | 0.2 | Comparison |
| N | UV-15/UV-12 | 1/4 | 0.2 | " |
| O | " | " | 0.3 | " |
| P | " | " | 0.6 | " |
| Q | UV-15/UV-12/UV-26 | 2/8/5 | 0.3 | Invention |
| R | UV-15/UV-12/UV-31 | 2/8/5 | 0.3 | " |

Each of Samples M to R was sensitometrically gradationally exposed to light, developed, bleach-fixed and tested for light-fastness in the same manner as described in Example 1. The results obtained are shown in Table 8.

TABLE 8

| Sample | Xenon | | | Fluorescent Lamp | | | Sunlight | | | |
|---|---|---|---|---|---|---|---|---|---|---|
| No. | Cyan | Magenta | Yellow | Cyan | Magenta | Yellow | Cyan | Magenta | Yellow | Remark |
| M | 1.63 | 1.75 | 1.77 | 1.68 | 1.72 | 1.75 | 1.63 | 1.70 | 1.77 | Comparison |
| N | 1.63 | 1.74 | 1.76 | 1.67 | 1.72 | 1.75 | 1.62 | 1.70 | 1.76 | " |
| O | 1.68 | 1.76 | 1.77 | 1.73 | 1.74 | 1.76 | 1.70 | 1.72 | 1.77 | " |
| P | 1.77 | 1.80 | 1.80 | 1.80 | 1.78 | 1.77 | 1.75 | 1.76 | 1.79 | " |
| Q | 1.78 | 1.79 | 1.79 | 1.80 | 1.78 | 1.77 | 1.77 | 1.76 | 1.80 | Invention |
| R | 1.77 | 1.80 | 1.80 | 1.80 | 1.79 | 1.78 | 1.77 | 1.76 | 1.78 | " |

It can be seen from the results of Table 8 that Sample P exhibits markedly improved light-fastness of the cyan image as compared with Sample N. This improvement is attributed to the threefold increase in coverage of the 2-(2'-hydroxyphenyl)benzotriazole ultraviolet absorbent. Light-fastness equal to Sample P can be assured in Samples Q and R with half the coverage of the ultraviolet absorbent used in Sample P. Similar effects are also produced with respect to a magenta image having high light-fastness, although light-fastness of the magenta image itself is high.

From all these considerations, it can be seen that a combined use of the 2-(2'-hydroxyphenyl)benzotriazole ultraviolet absorbents and the benzophenone ultraviolet absorbents is very effective to improve light-fastness, particularly of a cyan image, as well as light-fastness of a magenta image, to thereby provide a well-balanced color image, as is shown in Table 8.

As described above, light-fastness of a cyan image can be significantly improved by combining the 2-(2'-hydroxyphenyl)benzotriazole compounds of the formula (II) and the benzophenone compounds of the formula (III) as an ultraviolet absorbent. It is, therefore, obvious that the present invention is very effective to improve light-fastness of a cyan image and thereby to improve an overall color balance. In such a combined ultraviolet absorbent system, satisfactory fastness of a cyan image to heat and moisture can also be assured.

Further, it was confirmed that the above-described effects of improving light-fastness of a cyan image and thereby of improving an overall color fading balance with a relation to yellow image and magenta image can be produced irrespective of the layer structure.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a reflection support having provided thereon a silver halide emulsion layer containing at least one cyan coupler represented by formula (I)

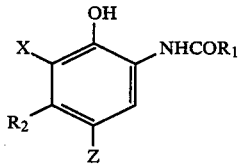

(I)

wherein $R_1$ represents a substituted or unsubstituted aliphatic, aromatic, or heterocyclic group or a substituted or unsubstituted aromatic amino or heterocyclic amino group; $R_2$ represents a substituted or unsubstituted acylamino group; X represents a hydrogen atom, a halogen atom, a substituted or unsubstituted aliphatic or aromatic group or a substituted or unsubstituted acylamino group; Z represents a hydrogen atom or a group releasable upon oxidative coupling with a developing agent; or $R_2$ and X together form a 5- to 7-membered ring; and the coupler may be a polymer, inclusive of a dimer, formed at one of $R_1$, $R_2$, X, and Z; and at least one cyan coupler represented by formula (V)

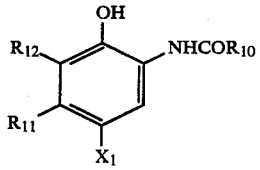

(V)

wherein $X_1$ represents a hydrogen atom or a halogen atom; $R_{10}$ and $R_{12}$ each represents a substituted or unsubstituted aliphatic, aromatic or heterocyclic group or a substituted or unsubstituted aromatic amino or heterocyclic amino group, or a substituted or unsubstituted acylamino group; $R_{12}$ further represents a chlorine atom; and $R_{11}$ represents a substituted or unsubstituted aliphatic group having 2 or more carbon atoms or a methyl group having a substituent; a silver halide emulsion layer containing a pyrazoloazole magenta coupler, and a silver halide emulsion layer containing a yellow coupler, wherein at least one of said silver halide emulsion layer containing said cyan couplers and a photographic layer that is farther from the support than the cyan coupler-containing silver halide emulsion layer contains at least one 2-(2'-hydroxyphenyl)benzotriazole compound represented by formula (II)

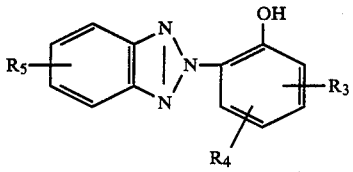

(II)

wherein $R_3$, $R_4$, and $R_5$ each represents a hydrogen atom, a halogen atom, a nitro group, a hydroxyl group, or a substituted or unsubstituted alkyl, alkoxy, aryl, aryloxy, or acylamino group;

and at least one benzophenone compound represented by formula (III)

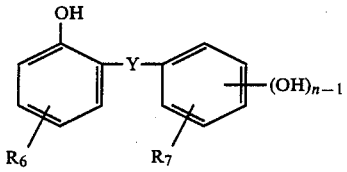

(III)

wherein $R_6$ and $R_7$ each represents a hydrogen atom or a substituted or unsubstituted alkyl, alkoxy, or acyl group; Y represents —CO— or —COO—; and n represents an integer of from 1 to 4.

2. A silver halide photographic material as in claim 1, wherein the aliphatic group as represented by $R_1$ contains from 1 to 36 carbon atoms, the aromatic group as represented by $R_1$ contains from 6 to 36 carbon atoms, the acylamino group as represented by $R_2$ contains from 1 to 36 carbon atoms, the aliphatic group as represented by X contains from 1 to 20 carbon atoms, the aromatic group as represented by X contains from 6 to 20 carbon atoms, the acylamino group as represented by X contains from 2 to 20 carbon atoms, and the ring formed by $R_2$ and X is a 5- to 6-membered nitrogen-containing heterocyclic ring derived from an acylamino group.

3. A silver halide photographic material as in claim 1, wherein said cyan couplers are represented by formula (IV)

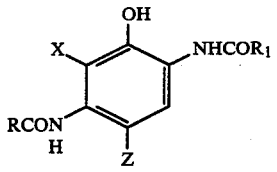

(IV)

wherein $R_1$, X and Z represent the same meaning as defined in claim 1; R represents a substituted alkyl group or a substituted aryl group; or X and R together form a 5- to 7-membered ring.

4. A silver halide photographic material as in claim 1, wherein said photographic layer is a protective layer, a silver halide emulsion layer or an intermediate layer.

5. A silver halide photographic material as in claim 1, wherein said 2-(2'-hydroxyphenyl)benzotriazole compound or compounds and benzophenone compound or compounds are present in a total amount of from 0.01 to 2 parts by weight per part by weight of a binder in the layer in which they are contained.

6. A silver halide photographic material as in claim 1, wherein the weight ratio of the benzophenone compounds to the 2-(2'-hydroxyphenyl)benzotriazole compounds is from 0.1/1 to 2/1.

7. A silver halide photographic material as in claim 1, wherein said photographic layer containing the 2-(2'-hydroxyphenyl)benzophenone compound or compounds and the benzophenone compound or compounds is coated on the side thereof opposite to the support with a light-insensitive layer consisting essentially of a binder.

8. A silver halide photographic material as in claim 3, wherein said photographic layer is a protective layer, a silver halide emulsion layer or an intermediate layer.

9. A silver halide photographic material as in claim 3, wherein said 2-(2'-hydroxyphenyl)benzotriazole compound or compounds and benzophenone compound or compounds are present in a total amount of from 0.01 to 2 parts by weight per part by weight of a binder in the layer in which they are contained.

10. A silver halide photographic material as in claim 3, wherein the weight ratio of the benzophenone compounds to the 2-(2'-hydroxyphenyl)benzotriazole compounds is from 0.1/1 to 2/1.

11. A silver halide photographic material as in claim 3, wherein said photographic layer containing the 2-(2'-hydroxyphenyl)benzophenone compound or compounds and the benzophenone compound or compounds is coated on the support and superimposed with a light-insensitive layer consisting essentially of a binder.

12. A silver halide photographic material as in claim 1, wherein at least one of said silver halide emulsion layer containing a magenta coupler and a photographic layer that is farther from the support than the magenta coupler-containing silver halide emulsion layer further contains at least one 2-(2'-hydroxyphenyl)benzotriazole compound represented by formula (II) and at least one benzophenone compound represented by formula (III).

13. A silver halide photographic material comprising a reflection support having provided thereon a silver halide emulsion layer containing at least one cyan coupler represented by formula (I)

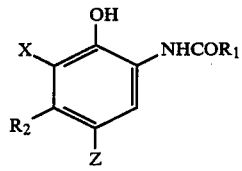

(I)

wherein $R_1$ represents a substituted or unsubstituted aliphatic, aromatic, or heterocyclic group or a substituted or unsubstituted aromatic amino or heterocyclic amino group; $R_2$ represents a substituted or unsubstituted acylamino group; X represents a hydrogen atom, a halogen atom, a substituted or unsubstituted aliphatic or aromatic group or a substituted or unsubstituted acylamino group; Z represents a hydrogen atom or a group releasable upon oxidative coupling with a developing agent; or $R_2$ and X together form a 5- to 7-membered ring; and the coupler may be a polymer, inclusive of a dimer, formed at one of $R_1$, $R_2$, $X_1$ and Z; and at least one cyan coupler represented by formula (V)

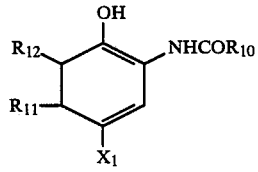

(V)

wherein $X_1$ represents a hydrogen atom or a halogen atom; $R_{10}$ and $R_{12}$ each represents a substituted or unsubstituted aliphatic, aromatic or heterocyclic group or a substituted or unsubstituted aromatic amino or heterocyclic amino group, or a substituted or unsubstituted acylamino group; $R_{12}$ further represents a chlorine atom; and $R_{11}$ represents a substituted or unsubstituted aliphatic group having 2 or more carbon atoms or a methyl group having a substituent; a silver halide emulsion layer containing a pyrazoloazole magenta coupler, and a silver halide emulsion layer containing a yellow coupler, wherein at least one of said silver halide emulsion layer containing a cyan coupler, said silver halide emulsion layer containing a magenta coupler, and a photographic layer that is farther from the support than the magenta coupler-containing silver halide emulsion layer contains at least one 2-(2'-hydroxyphenyl)benzotriazole compound represented by formula (II) emulsion layer contains at least one 2-(2'-hydroxyphenyl)benzotriazole compound represented by formula (II)

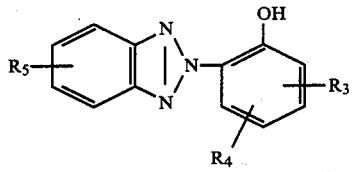

(II)

wherein $R_3$, $R_4$ and $R_5$ each represents a hydrogen atom, a halogen atom, a nitro group, a hydroxyl group, or a substituted or unsubstituted alkyl, alkoxy, aryl, aryloxy, or acylamino group; and at least one benzophenone compound represented by formula (III)

(III)
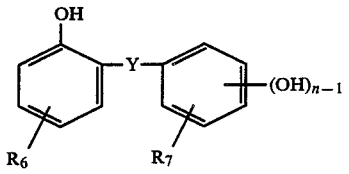
wherein $R_6$ and $R_7$ each represents a hydrogen atom or a substituted or unsubstituted alkyl, alkoxy, or acyl group; Y represents —CO— or —COO—; and n represents an integer of from 1 to 4.
14. A silver halide photographic material as in claim 1, wherein the silver halide emulsion layer containing the magenta coupler is the uppermost layer of silver halide emulsion layers.
* * * * *